US005931701A

United States Patent [19]

Pan et al.

[11] Patent Number: 5,931,701

[45] Date of Patent: Aug. 3, 1999

[54] ELECTRICAL CONNECTOR ASSEMBLY

[75] Inventors: Hua-Tseng Pan, Taipei; Marty Tuan, Hsin-Tien, both of Taiwan

[73] Assignee: Hon Hai Precision Ind. Co., Ltd., Taipei Hsien, Taiwan

[21] Appl. No.: 08/957,415

[22] Filed: Oct. 24, 1997

[30] Foreign Application Priority Data

Dec. 4, 1996 [TW] Taiwan ..... 85218942

[51] Int. Cl.[6] ..... H01R 23/70

[52] U.S. Cl. ..... 439/637

[58] Field of Search ..... 439/61, 631, 637, 439/636, 633, 634

[56] References Cited

U.S. PATENT DOCUMENTS 3,205,471 9/1965 Herrmann ..... 439/61
3,778,753 12/1973 Occhipinti et al. ..... 439/631
4,623,207 11/1986 Sasaki et al. ..... 439/631
5,575,687 11/1996 Tsai ..... 439/885

*Primary Examiner*—Neil Abrams
*Assistant Examiner*—T C Patel

[57] ABSTRACT

An electrical connector assembly for electrically connecting different type daughter board to a mother board, comprises a first connector housing, a second connector housing, a plurality of first contacts and a plurality of second contacts. The first connector housing includes a first slot for receiving one daughter board therein and a plurality of first passageways each receiving one first contact. The second connector housing integrally connected with said the first connector housing, includes a second slot for receiving another daughter board therein and a plurality of second passageways each receiving one second contact. A plurality of third passageways are defined between the slots wherein each third passageway consists of at least a first passageways and a second passageways in the structure thereof for receiving a first contact and a second contact which are alternately arranged. By means of the configuration of the connector assembly, the space occupied by the connector assembly on the mother board is significantly saved.

4 Claims, 4 Drawing Sheets

ELECTRICAL CONNECTOR ASSEMBLY

BACKGROUND OF THE INVENTION

1. Field of the Invention

The present invention relates to an electrical connector assembly for electrically connecting different type daughter boards to a mother board, and particularly to an electrical connector assembly which combines multi-connectors to save the occupied space on the mother board.

2. The Prior Art

Conventional edge card connectors used to electrically connect different plate-like daughter boards to the mother board of an electrical apparatus, can be divided into at least two type of connectors in accordance with the transmission speed and frequency of the different daughter board. One type is a low frequency, low transmission speed connector which is adapted to receive an industry standard architecture board as generally called "ISA". Another type is a high frequency, high transmission speed connector which is adapted to receive a peripheral component interconnecting board as generally called "PCI". The arrangement density of the contacts of two type connectors are completely different. However, to satisfy differing customer requirements, mother board manufacturers have to keep the two type connectors be mounted all onto each mother board, despite the fact that the two type connectors mounted on each mother board are not utilized all by each customer. Additionally, as known, the conventional electrical connectors mounted on the mother board are arranged apart from each other. Therefore, it is understood that while some of the connectors mounted on the mother board do not utilized by the customers, the connectors will result in a waste of space on the mother board.

Accordingly, to overcome the above disadvantages, an object of the present invention is to provide an electrical connector assembly with two different slots for electrically connecting two different type daughter boards to a mother board.

Another object of the present invention is to provide an electrical connector assembly with a plurality of first passageways each for receiving a first contact therein, a plurality of second passageways each for receiving a second contact, and a plurality of third passageways each defined with at least a first passageway and a second passageway for receiving a first contact and a second contact which are arranged alternately whereby the space occupied by the electrical connector assembly on the mother board is able to be significantly reduced.

Another object of the present invention is to provide an electrical connector assembly consisting of a first connector housing and a second connector housing which are integrally connected with each other for saving space occupied by the electrical connector assembly on the mother board.

SUMMARY OF THE INVENTION

According to an aspect of the invention, a combination electrical connector assembly for electrically connecting different type daughter boards, such as an ISA board or a PCI board with different transmission speed and frequency, to a mother board, mainly comprises a first connector housing, a second connector housing, a plurality of first contacts and a plurality of second contacts. The first connector housing includes a first slot for receiving a high transmission speed, high frequency daughter board, and a plurality of first passageways each receiving one first contact which extends into said first slot for electrically engaging with the high speed daughter board. The second connector housing integrally connected with said first connector housing, includes a second slot for receiving a low transmission speed, low frequency daughter board, and a plurality of second passageways each receiving one second contact which extends into said second slot for electrically engaging with the low speed daughter board. A plurality of third passageways are formed between the first connector housing and the second connector housing. Each third passageway is defined with at least a first passageway and a second passageway, for receiving a first contact and a second contact which are arranged alternately and separated by an abutment formed within the third passageway. By means of the configuration of the connector assembly, the space occupied by the connector assembly on the mother board is able to be significantly saved.

DETAILED DESCRIPTION OF THE PREFERRED EMBODIMENTS

Figure 1:
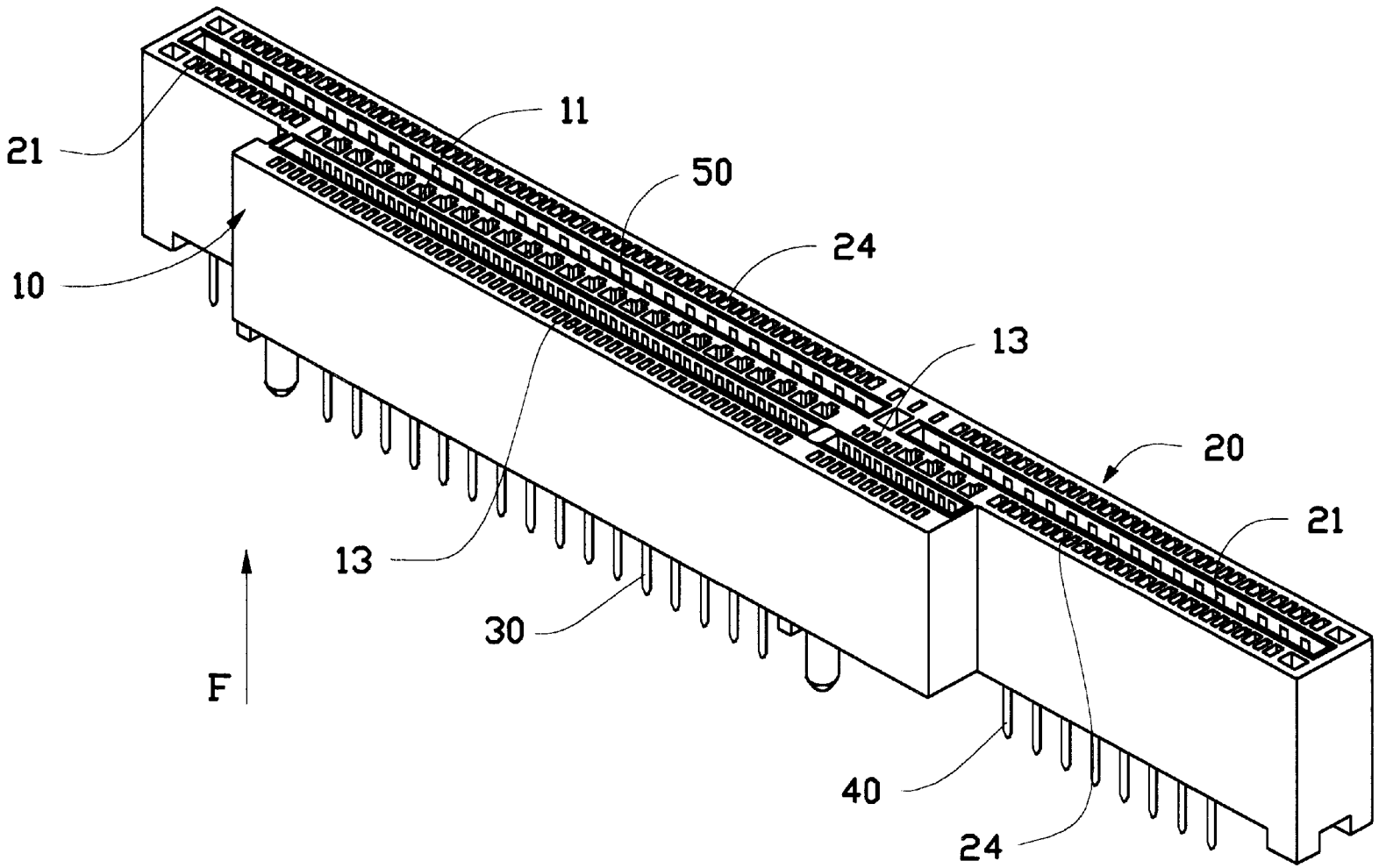
FIG. 1 is a perspective view of the electrical connector assembly in accordance with the present invention.
Figure 2:
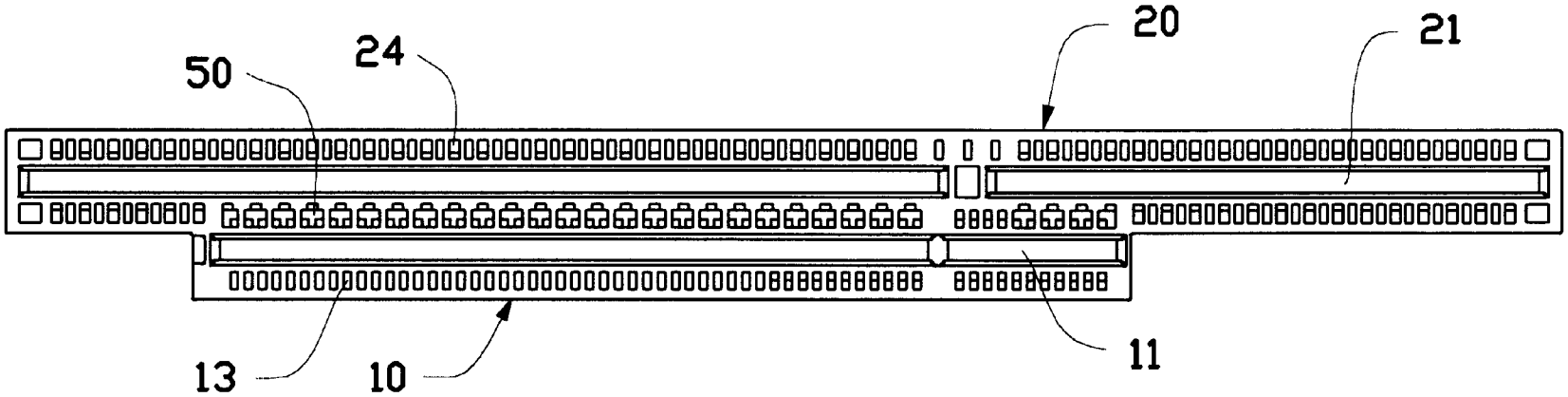
FIG. 2 is a top view of the electrical connector assembly in accordance with the present invention.

Reference will now be made in detail to the preferred embodiment of the invention. As shown in FIGS. 1 & 2, an electrical connector assembly for electrically connecting two different type daughter boards (not shown) to a circuit board (not shown) on which the electrical connector assembly 99 is mounted, mainly includes a first connector housing 10, a second connector housing 20, a plurality of first contacts 30 and a plurality of second contacts 40.

The elongated first connector housing 10 defines a first central slot 11 for receiving a high transmission speed, high frequency daughter board such as a PCI board (not shown). The elongated second connector housing 20 defines a second central slot 21 for receiving a low transmission speed, low frequency daughter board such as an ISA board (not shown). The first connector housing 10 and the second connector housing 20 are integrally connected side by side in a lateral direction with regard to said housings 10 & 20. A length of said first connector housing 10 is less than that of said second connector housing 20 for receiving a PCI daughter board which has a different length and a different circuits arrangement thereon with regard to those of ISA daughter board received within said second connector housing 20.

The first row of passageways arranged in an outer lateral side of the first connector housing 10 adjacent to the first cental slot 11, are configured with a plurality of first passageways 13 wherein each first passageway 13 receives a first contact 30 having a first engaging section 31 (shown in FIG. 4) extending into said first slot 11 for electrically engaging with a high transmission speed daughter board. The second row of passageways arranged in an outer lateral side of the second connector housing 20 adjacent to the second central slot 21, are configured by a plurality of second passageways 24 wherein each second passageway 24 receives a second contact 40 having a second engaging section 41 (shown in FIG. 4) extending into said second slot 21 for electrically engaging with a low transmission speed daughter board. However, it is noted that because the first connector housing 10 is adapted to receive a high transmission speed daughter board, and the second connector housing 20 is adapted to receive a low transmission speed daughter board, the arrangement density of first passageways 13 of the first connector housing 10 is designed to be higher than that of second passageways 24 of the second connector housing 20.

Figure 3:
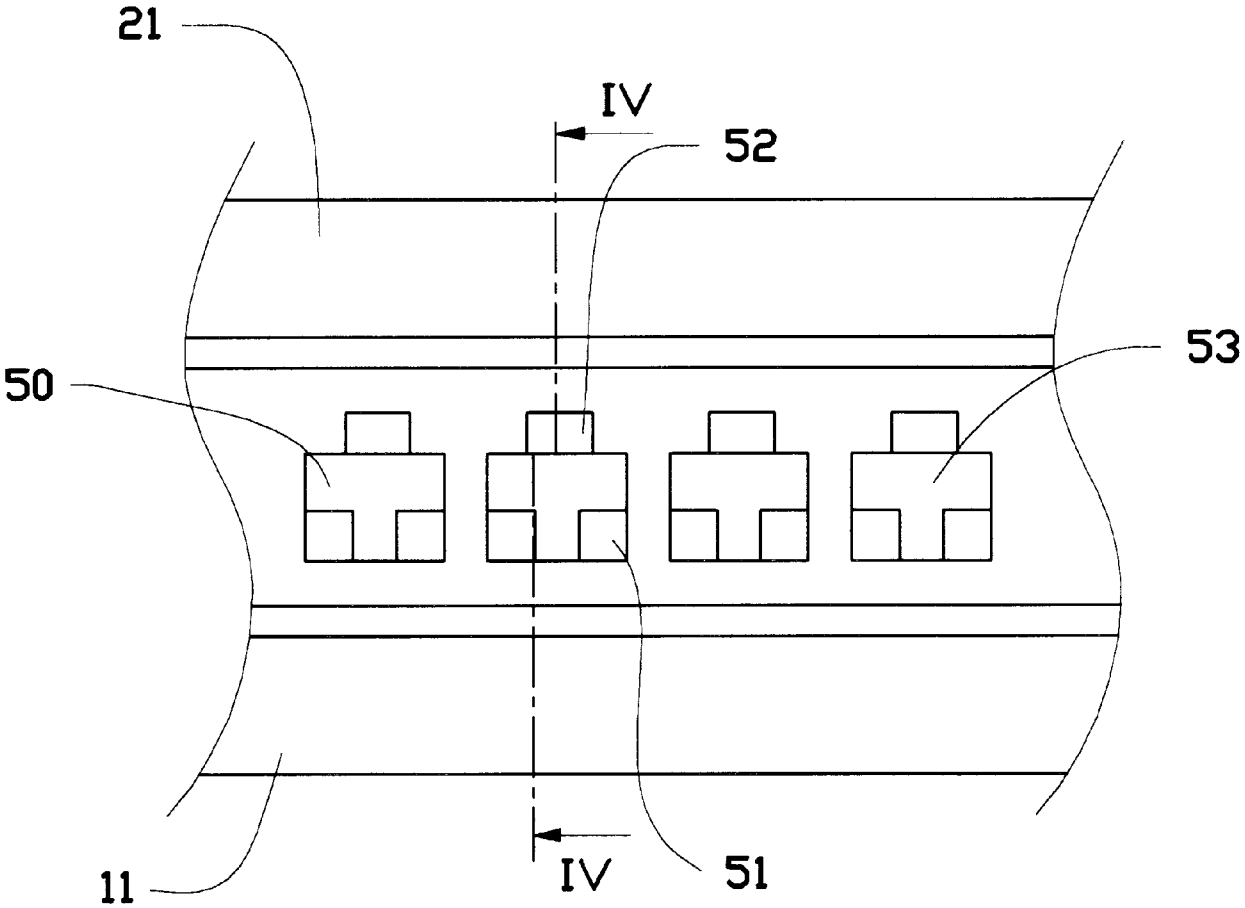
FIG. 3 is a partially enlarged view of the electrical connector assembly in accordance with FIG. 2 showing the third passageways without any contacts received therein.
Figure 4:
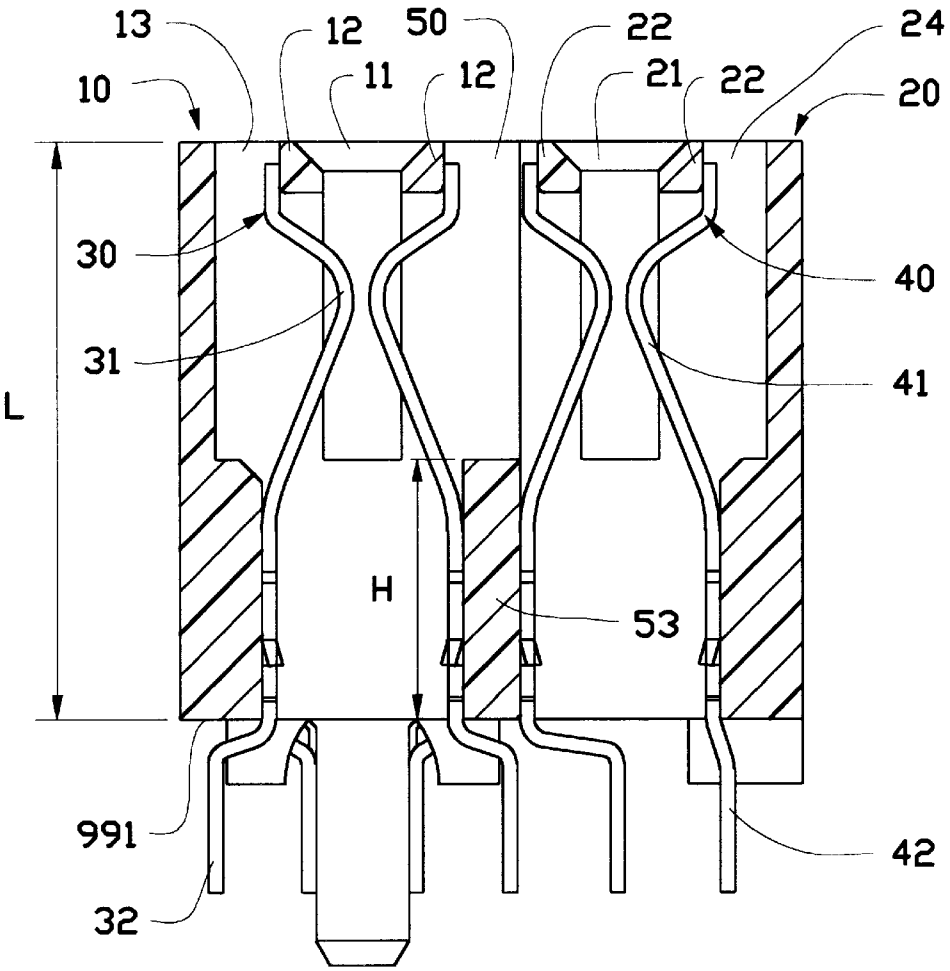
FIG. 4 is a cross-sectional view of the electrical connector assembly along line IV—IV of FIG. 3 showing the insertion of the first and second contacts.

The third row of passageways arranged on a connecting location between the first connector housing 10 and the second connector housing 20, consists of a number of first passageways 13, second passageways 24 and third passageways 50 wherein said third passageways 50 are defined between the first cental slot 11 and the second central slot 21, and communicate with both slots 11, 21 as shown in FIGS. 3 & 4.

Referring to FIGS. 2–4, the configuration of most of the third passageways 50, each is defined as the lateral combination of a second passageway 24 and two first passageways 13 in mutual communications with each other. Each third passageways 50 receive two first contacts 30 and one second contact 40 therein which respectively extend into the first slot 11 and the second slot 21. Some of the third passageways 50 (shown in FIG. 2), each provide a combination of a first passageway 13 and a second passageway 24 in communication with each other, to respectively receive a first contact 30 and a second contact 40 therein which respectively extend into the first slot 11 and the second slot 21. The first contact 30 and the second contact 40 in the third passageways 50 are alternately arranged along a longitudinal direction of the connector assembly to avoid a face-to-face engagement between the first contact 30 and the second contact 40 which may result in a short circuit when any daughter board is inserted into either the first slot 11 or the second slot 21. A partition 53 having a height "H" which is less than a height "L" of the housings 10, 20, is formed in a lower portion of each third passageway 50 to isolate each first contact 30 from each second contact 40 along a horizontal direction of the connector assembly.

In addition, each third passageway 50 further includes a first abutment 12 for resisting the resilience of a free end (not labeled) of the first contact 30 toward the first central slot 11 when an inserted daughter board (not shown) is withdrawn from the first central slot 11, and a second abutment 22 for resisting the resilience of a free end (not labeled) of the second contact 40 toward the second central slot 21 when an inserted daughter board (not shown) is withdrawn from the second central slot 21. Therefore, the design of the third passageways 50 receiving both first contacts 30 and second contacts 40 enables the connector assembly 99 to occupy less space on the mother board.

The engaging section 31, 41 of each contact 30, 40 is further able to electrically contact with a circuit pad (not shown) formed on a surface of a corresponding daughter board which is inserted within the central slots 11, 21. A solder tail 32, 42 of each contact 30, 40 extends beyond a bottom surface 991 of the connector assembly to cooperate with a corresponding aperture of the mother board (not shown).

It is noted that the two different type connector housings of the embodiment does not limit the spirit of the present invention. In fact, the present invention suggests that more than two different type connector housings are combined to receive different type daughter boards and to save more space occupied by the connectors on the mother board.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

We claim:

1. An electrical connector assembly for electrically connecting different type daughter boards to a mother board above which the connector assembly is mounted, comprising:

a plurality of first contacts for electrically engaging with a first daughter board, each of said first contacts having a first free end and an opposed first solder tail; a plurality of second contacts for electrically engaging with a second daughter board, each of said second contacts having a second free end and an opposed second solder tail; and insulative housing means defining a plurality of passageways and at least two slots for respectively receiving at least said first and second daughter boards, a central passageway integrally formed between said at least two slots, said central passageway forming a first abutment and a second abutment, said central passageway receives at least one of said first contacts and one of said second contacts therein for saving space which the connector assembly occupies on the mother board whereby the first and second abutments may respectively resist the resilience of the first and second free ends toward the slots, and the first and second solder tails extend beyond the connector assembly to cooperate with the mother board.

2. The electrical connector assembly as described in claim 1, wherein said passageways includes some first passageways for receiving said first contacts therein.

3. The electrical connector assembly as described in claim 2, wherein said passageways includes some second passageways for receiving said second contacts therein.

4. The electrical connector assembly as described in claim 1, wherein said passageway receiving the first contact and the second contact forms therein a partition to separate the first contact and the second contact.

* * * * *